US005355602A

United States Patent [19]

Menke et al.

[11] Patent Number: 5,355,602

[45] Date of Patent: Oct. 18, 1994

[54] DISPLAY DEVICE

[75] Inventors: Wilhelm Menke, Ingelheim; Paul Himmelsbach, Bad Kreuznach; Enrico Kämpfer, Bingen, all of Fed. Rep. of Germany

[73] Assignee: NSM Aktiengesellschaft, Bingen, Fed. Rep. of Germany

[21] Appl. No.: 916,083

[22] PCT Filed: Jan. 19, 1991

[86] PCT No.: PCT/DE91/00051

§ 371 Date: Jun. 24, 1992

§ 102(e) Date: Jun. 24, 1992

[87] PCT Pub. No.: WO91/11786

PCT Pub. Date: Aug. 8, 1991

[30] Foreign Application Priority Data

Jan. 23, 1990 [DE] Fed. Rep. of Germany ..... 4001785

[51] Int. Cl.[5] ..... G09F 11/00

[52] U.S. Cl. ..... 40/476; 40/509

[58] Field of Search ..... 40/470, 476, 509, 510, 40/511, 361

[56] References Cited

U.S. PATENT DOCUMENTS

| | | | |
|---|---|---|---|
| 1,204,177 | 4/1912 | Bradley | 40/476 |
| 1,322,175 | 11/1919 | Birdsall | 40/476 |
| 1,539,683 | 5/1925 | McDonald | 40/476 |
| 1,611,926 | 12/1926 | McDonald | 40/476 |
| 1,618,718 | 2/1927 | Lees . | |
| 3,616,556 | 11/1971 | Williams . | |
| 3,798,811 | 3/1974 | Rockola . | |
| 4,970,814 | 11/1990 | Briscoe . | |
| 5,048,209 | 9/1991 | Ackeret . | |

FOREIGN PATENT DOCUMENTS

| | | |
|---|---|---|
| 0113057 | 7/1984 | European Pat. Off. . |
| 0304501 | 3/1989 | European Pat. Off. . |
| 2044028 | 1/1973 | Fed. Rep. of Germany . |
| 2307309 | 4/1979 | Fed. Rep. of Germany . |
| 3737585 | 5/1989 | Fed. Rep. of Germany . |
| 2626100 | 7/1989 | France . |
| 8802532 | 4/1988 | PCT Int'l Appl. . |
| 8909947 | 10/1989 | PCT Int'l Appl. . |
| 2067331 | 7/1981 | United Kingdom . |

*Primary Examiner*—Brian K. Green

*Attorney, Agent, or Firm*—Spencer, Frank & Schneider

[57] ABSTRACT

A display device, particularly for the display of music titles in a jukebox includes a frame housing, two juxtaposed stacks of information carriers arranged vertically one behind the other, with a front information carrier of a first one of the stacks of information carriers and a rear information carrier of a second one of the stacks of information carriers being simultaneously displaceable by a displacing mechanism relative to one another toward the respective other stack of information carriers. In order to displace the respective front and rear information carriers, the two stacks of information carriers are movable by the displacing mechanism relative to one another in synchronized steps and offset by the thickness of an information carrier. The direction of movement of the movable and displaceable information carriers is reversible by a reversing mechanism. The information carriers of each stack of information carriers are supported at edges thereof in the threads of threaded spindles. The threaded spindles of one stack of information carriers is driven in an opposite direction but in synchronism with threaded spindles of the other stack of information carriers.

8 Claims, 3 Drawing Sheets

DISPLAY DEVICE

BACKGROUND OF THE INVENTION

1. Field of the Invention

The invention relates to a display device, particularly for the display of music titles in a jukebox.

2. Background of the Invention

Jukeboxes offer the user a large number of musical selections, usually in the order of magnitude of several hundred individual music compositions, with presently, for example, up to twenty music compositions being stored on a single compact disc record. The possible selections are usually displayed on a program listing in the form of a display from which the user is able to input, after the insertion of an appropriate amount of money into the jukebox, by way of a keyboard leading to the selection system of the jukebox, the code for his desired selection with respect to one or several music pieces and to thus initiate the playback process. The display of a large selection of music titles thus requires a relatively large viewing area.

German Patent 2,307,309 already discloses a display device for a jukebox including a plurality of superposed parallel polygonal drums that are rotatable about axial shaft stubs and are each equipped with a plurality of essentially planar viewing surfaces and with holding elements for holding a strip card carrying a visually readable display. The polygonal drums are coupled with a drive which, when actuated, rotates all polygonal drums simultaneously about the same angular path so that a different viewing surface of each polygonal drum is turned into the viewing position. To enlarge the program offerings, a plurality of such display devices may be arranged next to one another. Although it is possible to enlarge the program offering in this way, this can be done only to a certain degree since, for example, if more than one thousand music titles are available, the space requirement for the polygonal drums becomes too great. Moreover, the drives for the individual polygonal drums are relatively susceptible to malfunction which leads to frequent malfunction of the display device.

Additionally, German Patent 2,044,028 discloses a device for displaying music titles in a jukebox equipped with a series of flat information carriers that are arranged one behind the other on an endless conveyor and are pivotal about a transverse axis so as to be inscribed on both sides. During their rotation, the information carriers can be moved within a guide equipped with interior and exterior guide walls past a housing window. In order to automatically pivot the information carriers about 180°, a turning device is provided which is disposed at one point in the path of revolution of the information carriers where the guide is interrupted. The endless conveyor with the information carriers can be manually moved as required in opposite directions of rotation, with the information carriers being pivoted independently of their direction of rotation. Such a device as well, if it is designed for the display of a very large number of music titles, requires a relatively large installation space and is additionally extremely subject to malfunction due to its complicated structure.

Finally, DE 3,737,585.A1 discloses a display device for a coin-operated jukebox in which the display device is configured as an externally switchable flip card carousel whose flip cards are each inscribed with the music titles on their front and back faces, with the flip cards being pivotally mounted on a flip card holder that is rotatable in only one direction by means of a drive member so that, whenever they pass by a tab that is fixed to the housing, they flip from a position in which their frontal face is displayed to a position in which their rear face is displayed. Although a plurality of music titles can be displayed on each flip card, the flip card carousel as a whole, due to the rotational movement of the individual flip cards about the flip card holder, requires a comparatively deep installation space. Moreover, when passing the tab attached to the housing, the flip cards are subject to increased wear which may lead to the malfunction of the flip card carousel.

SUMMARY OF THE INVENTION

It is the object of the invention to create a display device of the above-mentioned type which, with a small structural volume and a simple configuration, provides for the display of a very large amount of information.

This is accomplished by the invention in that

- two juxtaposed stacks of information carriers arranged vertically one behind the other are disposed in a frame housing, with the frontal faces of the information carriers being configured as display surfaces;
- the two stacks are movable relative to one another in synchronous steps offset by the thickness of one information carrier;
- the front information carrier of the one stack and the rear information carrier of the other stack in the offset stack arrangement, are simultaneously displaceable toward the respective other stack; and
- the direction of rotation of the movable and displaceable information carriers is reversible.

With these measures there results an extremely compact display device that requires only a relatively small installation space, wherein the transport of the individual information carriers into the viewing direction of the viewer takes place practically within the space requirement of the two juxtaposed information carrier stacks. A large amount of information can be accommodated on the frontal faces of the stacks of information carriers to make the information accessible to the viewer. Moreover, the reversal of the direction of rotation of the information carriers can quickly return information that has just moved past the viewer back into the viewer's viewing field. Therefore, this display device is particularly suitable for the offering and selection of music titles in a jukebox. Moreover, any desired installation position is possible for the display device. Additionally, a plurality of display devices can be combined into a structural unit without greater engineering expenditures in order to enlarge the information offering.

In order to realize easy displaceability of the information carrier stacks, an advantageous feature of the invention provides that the edges of the information carriers of each stack are mounted in the threads of threaded spindles, with the threaded spindles of the one stack being driven in synchronism with, but in the opposite direction to, the threaded spindles of the other stack. Advisably, each information carrier stack has four associated threaded spindles which are arranged in pairs opposite one another and are mounted in the upper and lower transverse carriers of the frame rack.

In order to realize an accurate, slip-free drive for the threaded spindles, the threaded spindles are provided, according to an advantageous modification of the invention, with a toothed wheel which projects on the spindle axis beyond the rear wall of the frame housing and rotates with it, and the toothed wheels of the threaded spindles belonging to one information carrier stack mesh jointly with a large toothed wheel, with one of the two meshing large toothed wheels being coupled by way of gears with a reversible-rotation drive motor.

In an advantageous further embodiment of the invention, the driven large toothed wheel drives two discs that are each connected so as to rotate with a toothed wheel and their edges move in the forks of associated fork couplers that generate positioning pulses, with their marking notches being offset by 180° relative to one another. Thus, there results a favorable monitoring of the offset and the flush positions of the information carrier stacks relative to one another.

In order to ensure reliable transfer of the information carriers from the one stack to the other stack, the information carrier stacks, in a further feature of the solution according to the invention, have two associated diametrally oppositely disposed carriers, of which the one engages into a carrying opening of the front information carrier of the one stack and the other into a carrying opening of the rear information carrier of the other stack, if the stacks are in an offset arrangement, and the carriers are movable in opposite directions and in synchronism along the two stacks by means of a displacement device.

In order to realize a reliably operating displacement device for the two carriers, the displacement device according to a modification of the invention includes two belt drives disposed in the region of the lower transverse carriers of the frame housing which are driven by way of a joint connecting shaft that is coupled by way of a gear assembly with a reversible-rotation drive motor, with the front carrier being fastened to an upper run and the rear carrier to a lower run of a respective belt drive.

In order to monitor end positions of the front carrier, the latter is preferably provided with an angled tab which, in the end positions of a carrier displacement path, drops into the fork of correspondingly arranged fork couplers that generate a position pulse.

In order for it to be possible to easily exchange the offered information in a jukebox, a further feature of the invention provides that the frontal face of each information carrier is provided with holding elements for the attachment of a cover and a music title information strip.

BRIEF DESCRIPTION OF THE DRAWINGS

The concept on which the invention is based will be defined in greater detail in the description below with reference to an embodiment that is illustrated in the drawing, in which.

DETAILED DESCRIPTION OF THE PREFERRED EMBODIMENT

Figure 1:
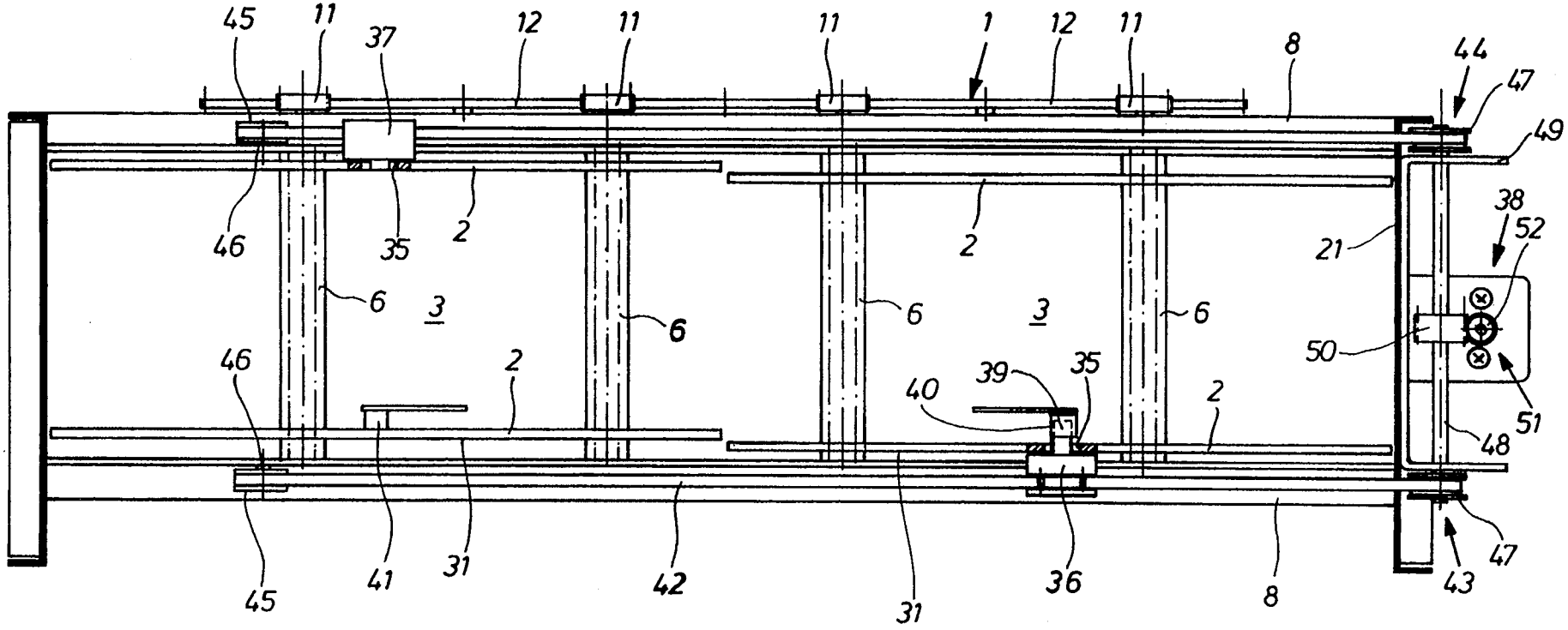
FIG. 1 is a simplified cross-sectional view of a display device for a jukebox.
Figure 2:
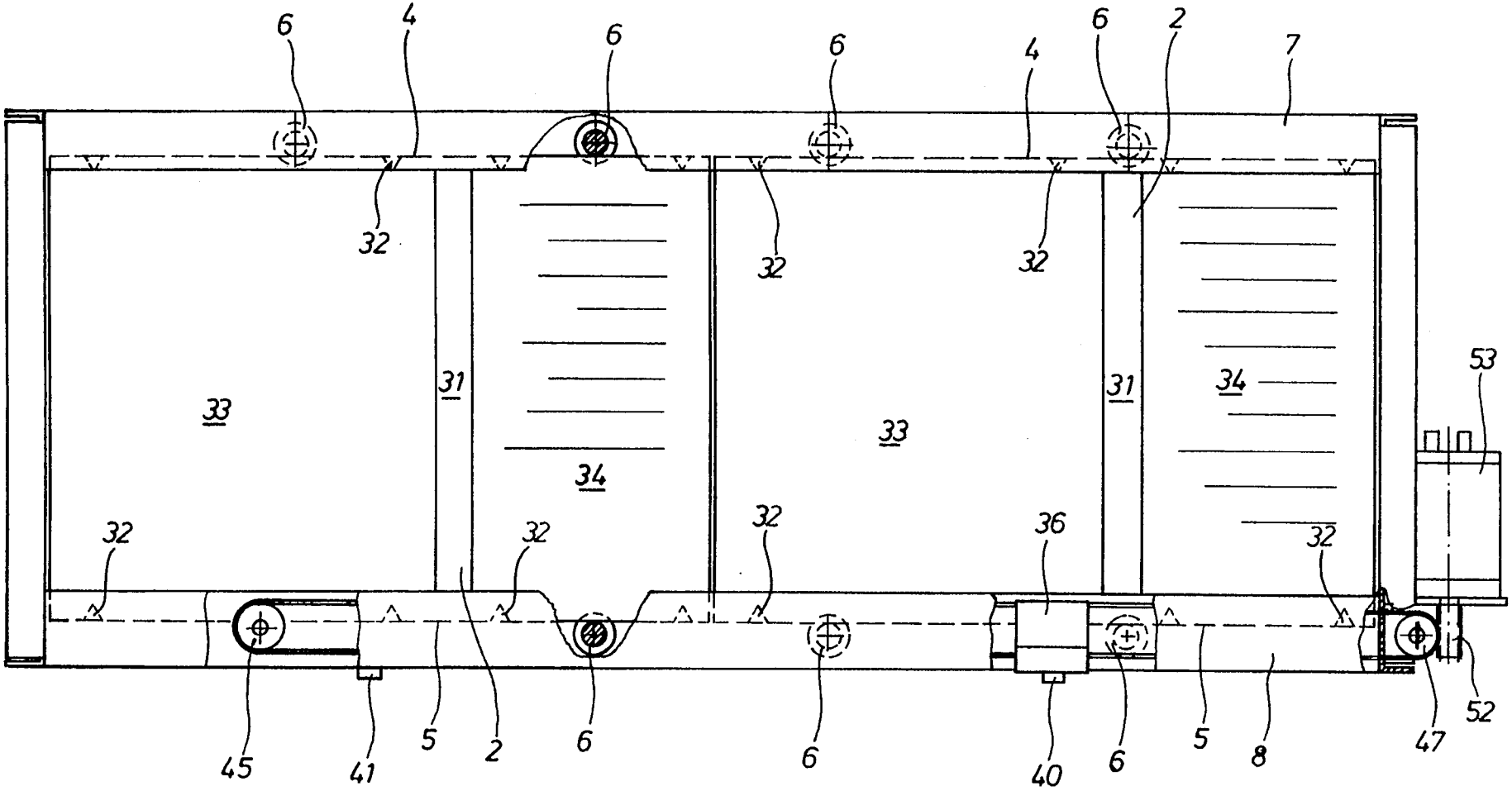
FIG. 2 is a front view of the display device according to FIG. 1.
Figure 3:
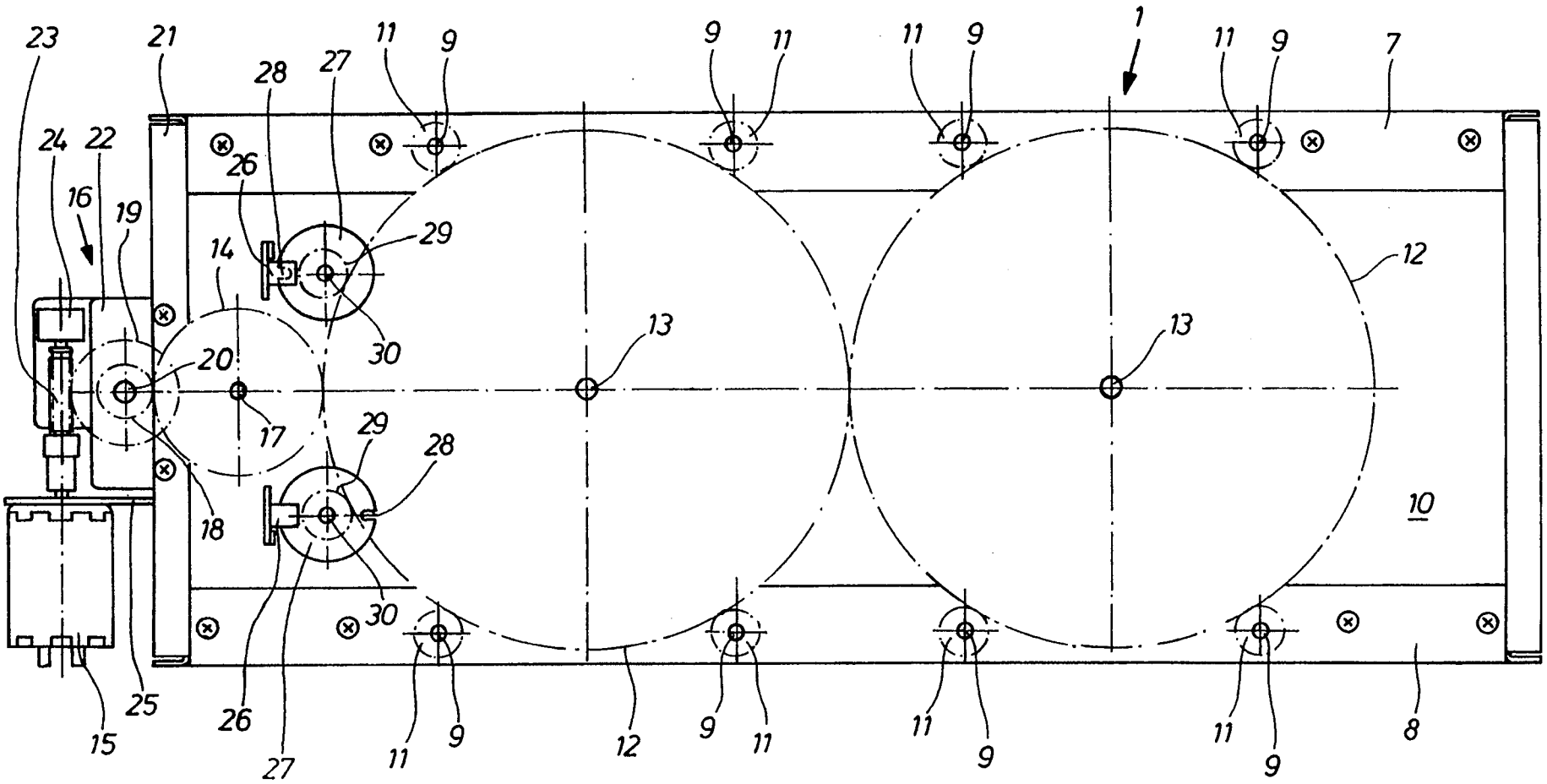
FIG. 3 is a rear view of the display device according to FIG. 1.

The display device includes a frame housing 1 in which two stacks 3 formed of information carriers 2 are arranged next to one another at the same height. Of each stack 3 formed of the same number of information carriers 2, FIG. 1 shows only the respective front and rear information carrier 2. The plate-shaped information carriers 2 of each stack 3 are arranged vertically one behind the other and their upper edges 4 and lower edges 5 are held in the threads of pairs of oppositely disposed threaded spindles 6. Thus each information carrier stack 2 is supported between four threaded spindles 6 two of which are mounted in the upper transverse carriers 7 and two in the lower transverse carriers 8 of frame housing 1. The shafts 9 of threaded spindles 6 project beyond the rear wall 10 of frame housing 1 and here each carry a relatively small toothed wheel 11 that rotates with them. The four toothed wheels 11 belonging to the threaded spindles 6 of an information carrier stack 3 mesh jointly with a large toothed wheel 12 that is mounted on a shaft 13 fastened to rear wall 10. The two large toothed wheels 12 mesh with one another so that the direction of rotation of the threaded spindles 6 of the one information carrier stack 3 is opposite to the direction of rotation of the threaded spindles 6 of the other information carrier stack 3. In the plane of the shafts 13 of the large toothed wheels 12, the one large toothed wheel 12 is in engagement with a toothed drive gear 14 that is a part of a gear assembly 16 that is coupled with a reversible rotation drive motor 15. The drive gear 14 mounted on a shaft 17 that is fastened to rear wall 10 meshes with a toothed wheel 18 that is connected and rotates with a worm wheel 19. Toothed wheel 18 and worm wheel 19 are mounted on a shaft 20 which is accommodated in a holder 22 that is attached to the exterior of side wall 21. A worm 23 that is connected with the shaft of drive motor 15 is in communication with worm wheel 19. The free end of worm 23 is supported at a bearing 24 that is attached to holder 22, while drive motor 15 is fastened to a carrying arm 25 that emanates from side wall 21.

In dependence on the charging of drive motor 15, the information carrier stacks 3 can be moved either into a position in which the information carriers 2 of both stacks 3 are precisely flush with one another or into a position in which the information carriers 2 of both stacks are offset relative to one another by the thickness of an information carrier 2. Two fork couplers 26 which are connected with a switching device in the display device serve to monitor these two stack positions. The edge of a disc 27 engages in the forks of each fork coupler, with the two discs 27 being provided with marking notches 28 that are offset by 180° relative to one another. Each disc 27 is connected and rotates with a toothed wheel 29 which meshes with the driven large toothed wheel 12 and is mounted together with disc 27 on a shaft 30 fastened to rear wall 10. The flush stack arrangement is taken up in order to offer the viewer a planar viewing surface including of the frontal faces 31 of the front information carriers 2. The frontal face 31 of each information carrier 2 is provided with holding elements 32 that are attached in a corresponding arrangement for accommodating a cover 33 and a music title information strip 34 whose music titles are each associated with a certain code for the input into a selection keyboard of the jukebox.

The offset stack arrangement permits the simultaneous displacement of the front information carrier 2 of the one stack 3 and the rear information carrier 2 of the other stack 3 toward the respective other stack. For this purpose, all information carriers 2 are provided in the center of their lower edges 5 with a carrying opening 35 and two diametrally oppositely disposed carriers 36 and 37 are associated with information carrier stacks 3. In the offset stack arrangement, the front carrier 36 engages in the carrying opening 35 of the front information carrier 2 of the one stack 3 and the rear carrier 37 engages in the carrying opening 35 of the rear information carrier 2 of the other stack 3. By way of a displacement device 38, the two carriers 36 and 37 can be moved in synchronism but in the opposite directions, that is, carriers 36 and 37 are able to simultaneously transport the front information carrier of one stack 3 and the rear information carrier 2 of the other stack 3 to the respective other stack 3. Thereafter, appropriate actuation of drive motor 15 permits the flush stack arrangement to be taken up again. In order to monitor the end positions of carriers 36 and 37, the front carrier 36 is provided with an angled tab 39 which, in the end positions of the carrier displacement path, drops into the fork of appropriately arranged fork couplers 40 and 41 which give a position pulse to the switching device.

The front carrier 36 is fastened to the upper run 42 of a belt drive 43 and the rear carrier 37 is fastened to the lower run of a belt drive 44. The reversal rollers 45 of the two belt drives 43 and 44 are supported on shafts 46 that are attached to the lower transverse carriers 8, while the drive rollers 47 are disposed on and rotate with a common connecting shaft 48. Connecting shaft 48 is mounted in a U-shaped holder 49 that is attached on the exterior of side wall 21. In its center, connecting shaft 48 accommodates the worm wheel 50 of a worm gear 51 in a rotationally secure arrangement. Worm 52, which meshes with worm gear 50 is coupled with the shaft of a reversible-rotation drive motor 53. By changing the direction of rotation of drive motor 53, a change results in the direction of movement of carriers 36 and 37 so that information carriers 2 can be exchanged between the stacks 3 in both directions in dependence on the direction of rotation of threaded spindles 6.

The above description of the drawings describes the details of the particularly simple and conveniently operated structure of the display device for a jukebox, a device that despite of its simplicity and compactness has been found to be extremely reliable. Although the invention was described only for one embodiment, modifications of the solution according to the invention that become evident from this description and lie within the scope of the claims are obvious for the person skilled in the art.

We claim:

1. A display device, particularly for the display of music titles in a jukebox including:

a frame housing, two juxtaposed stacks of movable and displaceable information carriers arranged vertically one behind the other, each of the information carriers having a thickness,.

displacing means for simultaneously displacing a front information carrier of a first one of the stacks of information carriers and a rear information carrier of a second one of the stacks of information carriers relative to one another toward the respective other stack of information carriers, wherein, in order to displace the respective front and rear information carriers, the two stacks of information carriers are movable by the displacing means relative to one another in synchronized steps and offset by the thickness of an information carrier, reversing means for reversing a direction of movement of the movable and displaceable information carriers, threaded spindles having threads for supporting the information carriers of each stack of information carriers at edges thereof, and wherein threaded spindles of one stack of information carriers is driven in an opposite direction but in synchronism with threaded spindles of the other stack of information carriers.

2. A display device according to claim 1, wherein the frame housing further comprises upper and lower transverse carriers, and wherein each stack of information carriers has four of said threaded spindles associated therewith, which are mounted in oppositely arranged pairs in the upper and lower transverse carriers of the frame housing.

3. A display device according to claim 2, wherein said threaded spindles each comprise a shaft projecting beyond a rear wall of the frame housing;

wherein the threaded spindles are each provided with a toothed wheel that rotates with them;

wherein each said toothed wheel of the threaded spindles belonging to a respective stack of information carriers each mesh jointly with a respective one of two mutually engaging large toothed wheels; and wherein one of the two mutually engaging large toothed wheels is driven by a gear assembly and said displacing means includes a drive motor.

4. A display device according to claim 3, wherein the driven large toothed wheel drives two discs, wherein the two discs are each connected to rotate with the driven large toothed wheel by a respective further toothed wheel, wherein the two discs move with edges thereof in forks of associated respective fork couplers that generate positioning pulses, and wherein the two discs have marking notches offset by 180° relative to one another.

5. A display device according to claim 4, further comprising two diametrally opposed carriers associated with the stacks of information carriers wherein one of the two diametrally opposed carriers engages in a carrying opening in a front information carrier of one stack of information carriers and the other of the two diametrally opposed carriers engages in a carrying opening in a rear information carrier of the other stack of information carriers, if the stack arrangement is offset; and wherein the two diametrally opposed carriers are movable opposite to one another but in synchronism along the two stacks of information carriers by means of a displacement device.

6. A display device according to claim 5, wherein the displacement device includes two belt drives that are disposed in region of the lower transverse carriers of the frame housing and driven by a common connecting shaft that is coupled by way of a gear assembly with a reversible-rotation drive motor, a front one of the two diametrally opposed carriers being fastened to an upper run and a rear one of the two diametrally opposed carriers to a lower run of a corresponding one of the two belt drives.

7. A display device according to claim 6, wherein the front one of the two diametrally opposed carriers is provided with an angled tab which, in end positions of a carrier displacement path, drops into the fork of correspondingly arranged fork couplers that output position pulses.

8. A display device according to claim 1, wherein each information carrier is provided on a respective frontal face thereof with holding elements for accommodating a cover and a music title information strip.

* * * * *